US005763381A

United States Patent [19]

Hodgetts et al.

[11] Patent Number: 5,763,381

[45] Date of Patent: Jun. 9, 1998

[54] STARCHED-BASED ADJUNCTS FOR DETERGENTS

[75] Inventors: Robert W. Hodgetts, Longford; James M. Garvey, Reading, both of Great Britain; Daniel B. Solarek, Belle Mead, N.J.

[73] Assignee: National Starch and Chemical Investment Holding Corporation, Wilmington, Del.

[21] Appl. No.: 644,651

[22] Filed: May 7, 1996

Related U.S. Application Data

[63] Continuation-in-part of Ser. No. 527,662, Sep. 13, 1995, abandoned.

[51] Int. Cl.[6] ..... C11D 17/00; C11D 9/20; C11D 3/38; C11D 3/00

[52] U.S. Cl. ..... 510/299; 510/344; 510/400; 510/474; 510/528

[58] Field of Search ..... 510/474, 344, 510/299, 400, 528; 252/239, 240

[56] References Cited

U.S. PATENT DOCUMENTS

| | | | |
|---|---|---|---|
| 3,849,341 | 11/1974 | Lamberti | 252/546 |
| 4,906,744 | 3/1990 | Peuscher et al. | 536/63 |
| 5,520,840 | 5/1996 | Massaro et al. | 252/174.17 |

FOREIGN PATENT DOCUMENTS 55-155097 12/1980 Japan .

OTHER PUBLICATIONS

Yihyon Paik & Graham Swift, "Polysaccharides as Raw Materials for the Detergent Industry", Chamistry & Industry, Jan. 16, 1995, pp. 55–59.

*Primary Examiner*—Mukund J. Shah
*Assistant Examiner*—Bruck Kifle
*Attorney, Agent, or Firm*—John D. Thallemer

[57] ABSTRACT

The detergent compositions of the present invention utilize cold-water-soluble starch, either chemically modified or not, as multifunctional detergent adjuncts, in amounts effective to impart simultaneously anti-redeposition properties and soil release properties to the detergent compositions.

3 Claims, No Drawings

STARCHED-BASED ADJUNCTS FOR DETERGENTS

CROSS REFERENCE TO RELATED APPLICATIONS

This application is a continuation-in-part of U.S. patent application Ser. No. 08/527,662, filed on Sep. 13, 1995, which application is now abandoned.

FIELD OF THE INVENTION

The present invention relates to detergent compositions which utilize starch as detergent adjuncts.

BACKGROUND OF THE INVENTION

A detergent is broadly composed of surfactants, builders and co-builders, and auxiliaries. Surfactants are usually low molecular weight organic compounds with balanced hydrophobic/hydrophilic characteristics and are normally anionic or nonionic in character, but they can be cationic or amphoteric. They are the primary cleaning or soil removing agents in the formulation.

Builders and co-builders are multipurpose additives which buffer the wash medium and alkaline pH, soften the water, promote cleaning, and disperse soil particles that are removed during the wash process. They typically are anionic, have a wide range of molecular weights from low to several thousand Daltons, and include polyphosphates, (poly)carboxylic acid salts, zeolites, sodium carbonate and citric acid.

Auxiliaries typically used in detergents include dispersants or anti-redeposition aids for soil dispersion and crystal growth inhibition, sequestrants which soften water by binding hard water ions such as calcium and magnesium, silicate anticorrosion agents, dye-transfer inhibitors, optical brighteners and soil release agents which remain on the fabric surface and promote soil removal. There are a wide variety of known compositions with a wide range of molecular weights among these compounds.

The detergent industry has worked for years to eliminate environmentally harmful materials from detergent compositions. One class of replacement materials examined as viable replacements for polycarboxylate detergent adjuncts is polysaccharides. On the one hand, polysaccharides are attractive alternatives due to the fact that they are abundant in nature and readily isolated and obtained in familiar forms such as starches, celluloses, and hemi-celluloses. They also are relatively inexpensive and generally accepted as biodegradable. On the other hand, it is known that polysaccharides are usually of little use as they are obtained because of the limited value of hydroxyl functionality in detergents. Conventional knowledge indicates that polysaccharides require some chemical modification or functionalization in order to be used in detergent compositions. However, this chemical transformation, depending on the extent, can change or interfere with biodegradability, since the enzymes that promote biodegradation of the natural polysaccharide may not work on the modified molecular structure.

Polysaccharide derivatives as a class generally are taught for use in the detergent industry. It is said that to act as surfactants polysaccharides must be modified in their hydrophobe/hydrophile balance. There has been considerable research activity on alkyl and alkylene polyglycosides obtained by the acid catalyzed alkylation of sugars for use as biodegradable surfactants. Such chemically modified glycosides are reported for use as nonionic surfactants in detergents. Anionic surfactants have been prepared by oxidizing the terminal hydroxy functionality of an ethoxylated polysaccharide. The catalytic oxidation is done in the presence of oxygen using a carbon supported noble metal catalyst of alkaline pH 9 and similar to that described for the oxidation of the primary alcohol groups of sucrose to give sequestering agents.

The industry has accepted the long-term need to replace the current polymeric carboxylic acids, poly(acrylic acid) and copoly(acrylic/maleic acids). The conversion of polysaccharides into builders and co-builders has received by far the most attention in the detergent industry. Polysaccharides which may be useful in detergents are taught to have anionic functionality, usually carboxyl functionality, introduced to act as sequestrants for builders and co-builders. These include, for example, carboxy methyl cellulose, used as an anti-redeposition agent. Polysaccharides are chemically modified at one or more of the available hydroxyl groups of the monomeric sugar units to introduce carboxylic acid functionality by oxidation, grafting, esterification and etherification in attempts to balance detergent performance and biodegradation. An alternative method for introducing carboxylic functionality into the polysaccharide molecule is by free radical polymerization of a suitable vinyl monomer such as acrylic acid or maleic acid. The esterification of the hydroxyl groups at $C_6$, the primary functionality, and $C_2$ and $C_3$, the secondary functionalities, with polycarboxylic acids for the appropriate control can introduce carboxyl functionality selectivity into the polysaccharide molecule. It is said that the major problem associated with the chemistry is the difficulty of avoiding branching and crosslinking of the polysaccharide when trying to introduce sufficient carboxyl groups for detergent activity, as branching and crosslinking impede biodegradability.

While the use of polysaccharides as surfactants and builders/cobuilders have been noted, polysaccharides have not been suggested heretofore for use as soil release agents. Soil release properties are different from anti-redeposition or dispersant properties, in that soil release agents actually enhance the removability of soil from the article being cleaned, while anti-redeposition agents or dispersants act to prevent the soil and other contaminates, such as scale and particulate matter found in the wash water, from being redeposited onto the article being cleaned.

It would be desirable to develop a polysaccharide which, when used in detergent compositions in proper amounts, imparts not only anti-redeposition properties to the detergent compositions but also imparts soil release properties to the detergent composition. The present invention satisfies both the long-felt need of the detergent industry to reduce the level of environmentally unfriendly adjuncts from detergents and the desire to develop a multifunctional, biodegradable detergent adjunct.

SUMMARY OF THE INVENTION

The present invention is directed to a detergent composition which comprises one or more cold-water-soluble starches, in amounts effective to impart both anti-redeposition properties and soil release properties to the detergent composition, a surfactant, a detergent builder, and a detergent auxiliary. The invention also is directed to methods of making a detergent composition exhibiting both anti-redeposition properties and soil release properties, the method comprising adding to the detergent composition an amount of cold-water-soluble starch, which may be a blend one or more cold-water-soluble starches, that is effective to impart both anti-redeposition properties and soil release properties to the detergent composition.

DETAILED DESCRIPTION OF THE INVENTION

While it has been reported that polysaccharides, as a broad class, may be used as builders in detergent compositions to impart anti-redeposition properties, there are no reports which indicate that polysaccharides, specifically starches, have been modified in any way specifically for the purpose of simultaneously imparting anti-redeposition and soil release properties to the detergent composition which utilizes the starch as a detergent adjunct. As exemplified herein below, detergent compositions which contain a starch which has not been treated to make it cold-water-soluble may exhibit anti-redeposition properties, but do not exhibit soil release properties. It now has been discovered that if a starch is treated in such a manner as to make the starch cold-water-soluble, not only will the cold-water-soluble starch impart anti-redeposition properties to the detergent composition, but the cold-water-soluble starch also will impart soil release properties to the detergent composition. This discovery was quite unexpected, especially in view of the discovery that starches which had not been treated to make them cold-water-soluble did not impart soil release properties to the detergent compositions. Accordingly, detergent compositions according to the invention must contain a cold-water-soluble starch in order to impart both anti-redeposition properties and soil release properties to the detergent composition.

The detergent compositions of the present invention utilize a cold-water-soluble starch in amounts effective to impart both anti-redeposition properties and soil release properties to the detergent composition. The cold-water-soluble starch may be derived from any of the known sources of starches such as arrowroot, wheat, sago, maize, potato, rice, tapioca, or the waxy starches. Preferred cold-water-soluble starches are derived from maize and potato starches. More preferred starches are cold-water-soluble waxy starches, including without limitation, waxy maize, waxy rice, waxy barley, and waxy potato.

The starch may have a viscosity ranging from about 10 WF to about 95 WF (water fluidity). More preferably, the starch will have a viscosity ranging from about 20 WF to about 90 WF, although the WF viscosity has not been shown to be critical to the multifunctionality of the cold-water-soluble starch. Neither does the degree of substitution (DS) appear to be critical to the multifunctionality of the cold-water-soluble starch. For practical purposes, it is preferred that the cold-water-soluble starch has a DS ranging from about 0.5 to about 3.

The starches may be chemically modified prior to treating them to make them cold-water-soluble, although cold-water-soluble starches which have not been chemically modified may be used in the detergent compositions of the present invention. For example, the starch may be esterified to introduce carboxyl functionality into the starch backbone. Exemplary anhydrides which may be used include alkenylsuccinic anhydride, alkylsuccinic anhydride, succinic anhydride, maleic anhydride and phthalic anhydride. Polyols, such as poly(alkylene oxides) may be incorporated into the starch prior to making the starch cold-water-soluble. The starches also may be reacted with carboxylic acids such as citric acid and 1,2,3,4-tetracarboxybutane. An alternative method of introducing carboxylate functionality into the starch molecule is by free-radical graft polymerization of a suitable vinyl monomer such as acrylic acid or maleic acid. Methods of oxidation of the starches have been discussed herein above. The starch also may etherified by reacting halocarboxylic acids in a Williamson's ether synthesis to produce carboxyalkyl starches. Other chemical modifications which typically are made to starches or which will be readily apparent to those skilled in the art having the benefit of this disclosure may also be used to prepare the cold-water-soluble starches according to the present invention. The cold-water-soluble starch may not be modified or treated in any way which renders the cold-water-soluble starch insoluble in cold water.

It is essential to the invention that the starches, chemically modified or otherwise, be treated to make them cold-water-soluble. By cold-water-soluble starch is meant a starch that when added to water at ambient temperature manifests a complete disruption of the granular structure and the formation of a colloidal dispersion.

In one treatment for making the starch cold-water-soluble, the starch may be pregelatinized by simultaneous cooking and spray drying. An aqueous slurry of the starch, either chemically unmodified or chemically modified, is fed into an atomizing chamber within a spray nozzle. A heating medium is injected into the atomizing chamber. The starch slurry is simultaneously cooked and atomized as the heating medium forces the starch through a vent at the bottom of the chamber. The atomized starch is then dried, preferably by spray-drying, although other methods of drying such as drum-drying may be used. Details of the process and reference to other processes are set forth in U.S. Pat. No. 5,149,799, in the name of Rubens, the contents of which are hereby incorporated by reference as if set forth herein in its entirety. Alternately, other methods which are known to those skilled in the art for making the starches cold-water-soluble may be used.

The detergent compositions will comprise an amount of the cold-water-soluble starch which is effective to impart simultaneously anti-redeposition properties and soil release properties to the detergent composition. The exact amount of the cold-water-soluble starch utilized in the detergent compositions will depend on such factors as the type of starch used, whether or not the starch has been chemically modified, the degree of such chemical modification and the molecular weight of the starch, for example. The detergent composition will contain from about 0.5 to about 50 weight percent of the cold-water-soluble starch, based on the total weight of the detergent composition, preferably from about 1 to about 50 weight percent. Even more preferably, the detergent compositions will contain from about 2.5 to about 30 weight percent of the cold-water-soluble starch, based on the total weight of the detergent composition.

In preparing the detergent compositions according to the present invention, the cold-water-soluble starch is formulated into the detergent in an amount which is effective to impart simultaneously anti-redeposition properties and soil release properties. The detergent will also comprise a detergent builder, a surfactant, and a detergent auxiliary. Detergent auxiliaries typically used in detergents include dispersants or anti-redeposition aids for soil dispersion and crystal growth inhibition, sequestrants which soften water by binding hard water ions such as calcium and magnesium, silicate anti-corrosion agents, dye-transfer inhibitors, optical brighteners, perfumes, fungicides, germicides, enzymes, hydrotropes and soil release agents which remain on the fabric surface and promote soil removal. In this sense, the cold-water-soluble starches according to the invention are multifunctional detergent auxiliaries, simultaneously performing the function of both an anti-redeposition auxiliary and a soil release auxiliary. Auxiliaries other than the cold-water-soluble starches are well known to those skilled in the art, as are the levels of use of such auxiliaries.

The surfactants which can be used in the detergent compositions of this invention include anionic, nonionic, amphoteric, zwitterionic, ampholytic and mixtures thereof. Levels of use for the particular surfactants are within the purview of one skilled in the art of detergent compositions. Preferably, the detergent composition will comprise from about 5 to about 50 weight percent of the surfactant, based on the total weight of the detergent composition.

Anionic surfactants which can be used in the compositions of this invention include both soap and non-soap detergent compounds. Examples of suitable soaps are sodium, potassium, ammonium and alkylolammonium salts of higher fatty acids ($C_{10}$–$C_{20}$). Examples of anionic organic non-soap detergent compounds are the water soluble salts, alkali metal salts of organic sulfuric reaction products having in their molecular structure an alkyl radical containing from about 8 to about 22 carbon atoms and a radical selected from the group consisting of sulfonic acid and sulfuric acid ester radicals. Included in the term alkyl is the alkyl portion of higher acyl radicals.

Nonionic surfactants may be broadly defined as compounds which do not ionize in water solution. For example, a well-known class of nonionic surfactants is made available on the market under the trade name of Pluronic. These compounds are formed by condensing ethylene oxide with an hydrophobic base formed by the condensation of propylene oxide with propylene glycol. Other suitable nonionic synthetic surfactants include:

(1) The polyethylene oxide condensates of alkylphenols, e.g., the condensation products of alkylphenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkylphenols. The alkyl substituent in such compounds may be derived from polymerized propylene, di-isobutylene, octene, dodecene or nonene, for example.

(2) Those derived from the condensation of ethylene oxide with the product resulting from the reaction of propylene oxide and ethylenediamine.

(3) The condensation product of primary or secondary aliphatic alcohols having from 8 to 18 carbon atoms, in either straight chain or branched chain configuration, with ethylene oxide.

(4) Long chain tertiary amine oxides corresponding to the following general formula, $R_1R_2R_3N\rightarrow O$, wherein $R_1$ is an alkyl radical of from about 8 to 18 carbon atoms and $R_2$ and $R_3$ are each methyl, ethyl or hydroxy ethyl radicals. The arrow in the formula is a conventional representation of a semi-polar bond.

(5) Long chain tertiary phosphine oxides corresponding to the following formula, $RR'R''P\rightarrow O$, wherein R is an alkyl, alkenyl or monohydroxyalkyl radical ranging from 10 to 18 carbon atoms in chain length and R' and R" are each alkyl or monohydroxyalkyl groups containing from 1 to 3 carbon atoms.

(6) Dialkyl sulfoxides corresponding to the following formula, $RR'S\rightarrow O$, wherein R is an alkyl, alkenyl, beta- or gamma-monohydroxyalkyl radical or an alkyl or beta-gamma-monohydroxyalkyl radical containing one or two other oxygen atoms in the chain, the R groups ranging from 10 to 18 carbon atoms in chain length, and wherein R' is methyl, ethyl or alkylol.

Ampholytic synthetic surfactants can be broadly described as derivatives of aliphatic secondary and tertiary amines, in which the aliphatic radical may be straight chain or branched and wherein one of the aliphatic substituents contains from about 8 to 18 carbon atoms and one containing an anionic water solubilizing group.

Zwitterionic synthetic surfactants can be broadly described as derivatives of aliphatic quaternary ammonium compounds, sulfonium compounds and phosphonium compounds in which the aliphatic radical may be straight chain or branched and wherein one of the aliphatic substituents contains from about 8 to 18 carbon atoms and one contains an anionic water solubilizing group.

Builders which can be used in the detergent compositions of this invention are those conventionally used in detergent compositions. Exemplary builders include polyphosphates, (poly)carboxylic acid salts, zeolites, sodium carbonate and citric acid. Builders, as used herein, is intended to include those materials used as co-builders in combination with conventional detergent builders noted above. As with the surfactants and detergent auxiliaries, the builders and the levels of use thereof are well within the purview of one skilled in the art of making detergent compositions. Preferably, the detergent composition will comprise from about 5 to about 75 weight percent of the builder, based on the total weight of the detergent composition.

The following examples are intended to describe further the invention but should not be construed in any way as limiting the scope of the invention, which is set forth in the claims appended hereto.

Evaluation Protocol:

Anti-Redeposition and Soil Release Testing

Test cloths of polyester/cotton and polyester were cut into swatches measuring 9 cm×9 cm. Four swatches of each type were placed together and washed 3 times in washing machines, according to the following conditions:

Temperature=60° C., $[Ca^{2+}]$=500 ppm, ballast of 570 g of terry cotton diapers, cycle duration of one hour 20 minutes, and wash liquor=13.5 $dm^3$.

The detergent was a commercial laundry detergent sold in the UK under the tradename, "Sainsbury's, Greencare Concentrated Automatic Washing Powder" containing by weight:

15 to 30% Zeolite
5 to 15% Sodium Carbonate
5 to 15% Sodium Citrate
5 to 15% Sodium Sulphate
5 to 15% Nonionic detergent
5 to 15% Sodium Disilicate
Less than 5% Soap
Carboxymethyl cellulose
Perfume A 64.8 g portion of this detergent, plus 2.7 g of starch, or sodium sulphate (control), was used in each wash.

The cloth swatches were then dried and ironed.

Half of the cloths were soiled with 5 g of a 1:1 mixture of red iron oxide and olive oil. Both the soiled and unsoiled swatches were pinned to the diapers used in the earlier washing. They were then washed a further three times under the same conditions, and using the same detergent/starch or detergent/sodium sulphate mixture as before.

The swatches were then dried and ironed. The reflectance of each swatch was measured 16 times on each side using a Minolta CR-300 reflectometer, and the results pooled and averaged.

The ΔR values were calculated using the following formula:

$$\Delta R = R - R_c$$

R=mean reflectance of cloth washed with detergent and starch $R_c$=mean reflectance of cloth washed with detergent and sodium sulphate The anti redeposition ΔR was calculated from the reflectance values of the cloths which had not been soiled. The anti-soil ΔR was calculated from the reflectance values of the cloths which had been soiled.

Starch Preparation:

Chemically modified and unmodified cold-water-soluble starches were prepared and compared to similarly chemically modified starches which were not cold-water-soluble. The description of the starch samples so prepared are set forth in Table 1.

TABLE 1

| Sample | Starch | Chemical Modification | C.W.S. |
|---|---|---|---|
| A | 85 WF Waxy Maize | None | Y |
| B | 85 WF Waxy Maize | HP[1] | Y |
| C | 85 WF Waxy Maize | HP | N |
| D | 56 WF Waxy Maize | 7% PO[2] | Y |
| E | 56 WF Waxy Maize | 7% PO | N |
| F | 76 WF Potato | 7% PO | Y |
| G | 76 WF Potato | 7% PO | N |
| H | 76 WF Potato | 13% OSA[3] | Y |
| I | 76 WF Potato | 13% OSA | N |
| J | 76 WF Maize | 13% OSA | Y |
| K | 76 WF Maize | 13% OSA | N |
| L | 24 WF Waxy Maize | 7% PO | Y |
| M | 24 WF Waxy Maize | 7% PO | N |
| N | 24 WF Waxy Maize | 13% OSA | Y |

[1]Hydroxypropyl
[2]Propylene oxide
[3]Octenylsuccinic anhydride

Each starch sample was formulated into the above described commercial laundry detergent (2.7 g starch in 64.8 g of base detergent) and each formulated detergent then evaluated for both soil release properties and anti-redeposition properties according to the above protocol. The samples were compared to the control detergent and the results of the evaluation set forth in Table 2. Delta R is the percent difference of reflectance noted at the 95% confidence level between the test sample and the control sample. An asterisk notes no statistical difference at the 95% confidence level between the test sample and the control sample.

TABLE 2

| | Delta R/Soil Removal | | | Delta R/Anti-redeposition | | |
|---|---|---|---|---|---|---|
| Sample | Cloth[1] 10A | Cloth[2] 20A | Cloth[3] 30A | Cloth[1] 10A | Cloth[2] 20A | Cloth[3] 30A |
| A CWS | * | 4.1 | * | 3.2 | 2.2 | 1.6 |
| B CWS | 2.5 | 7.0 | * | * | 2.1 | 1.9 |
| C CWS | * | * | * | 2.5 | 2.9 | 3.2 |

TABLE 2-continued

| | Delta R/Soil Removal | | | Delta R/Anti-redeposition | | |
|---|---|---|---|---|---|---|
| Sample | Cloth[1] 10A | Cloth[2] 20A | Cloth[3] 30A | Cloth[1] 10A | Cloth[2] 20A | Cloth[3] 30A |
| D CWS | 2.6 | 1.9 | * | 1.1 | 2.7 | 3.3 |
| E | * | * | * | 1.7 | 2.8 | 2.4 |
| F CWS | 2.6 | 1.9 | * | * | 1.6 | 0.8 |
| G | * | * | * | 1.4 | 2.7 | 1.7 |
| H CWS | * | 2.3 | * | 0.9 | 2.3 | 2.4 |
| I | * | * | * | 1.8 | 3.7 | 3.2 |
| J CWS | 2.9 | * | * | 1.3 | 3.5 | 2.0 |
| K | * | * | * | 2.4 | 4.3 | 2.9 |
| L CWS | 1.9 | 4.6 | | | 1.6 | 0.6 |
| M | NO SOIL REMOVAL EFFECT | | | SOME ANTI-REDEPOSITION EFFECT | | |
| N CWS | | 1.8 | 2.8 | 1.4 | 3.5 | 3.8 |

[1]Cloth 10A is cotton
[2]Cloth 20A is polyester cotton
[3]Cloth 30A is polyester As the data in Table 2 indicate, in every case the detergent composition which contained a cold-water-soluble starch, chemically modified or not, exhibited improved soil release properties on at least one of the test substrates, i.e. cotton, polyester or cotton/polyester blends. Detergent compositions containing starches which were not treated to make them cold-water-soluble exhibited anti-redeposition properties but did not exhibit any improvement in soil release properties compared to the control. Accordingly, those detergent compositions which contain cold-water-soluble starches have improved soil release properties compared to those detergent compositions which contain a starch which has not been treated to make it cold-water-soluble.

We claim:

1. In a detergent composition which comprises at least one surfactant, builder and auxiliary, the improvement comprising from about 0.5 to about 50 weight percent based on the weight of the detergent composition of at least one cold water-soluble starch selected from the group consisting of chemically modified starches which exhibit cold water solubility wherein the chemical modification is accomplished by a method selected from the group consisting of esterification and etherification, provided the cold water-soluble starch has a viscosity of from about 10 WF to about 95 WF and a degree of substitution of from about 0.5 to about 3.

2. The detergent composition according to claim 1 wherein the chemically modified starch is derived from a starch which is selected from the group consisting of arrowroot, wheat, sago, maize, potato, rice, tapioca starch and a waxy starch.

3. The detergent composition according to claim 2 wherein the starch selected from the group consisting of maize and potato starch.

* * * * *